United States Patent [19]

Tanase

[11] Patent Number: 4,885,817

[45] Date of Patent: Dec. 12, 1989

[54] AIR-DUST SEPARATION SYSTEM FOR A PNEUMATIC ROAD-CLEANING VEHICLE

[75] Inventor: Kozo Tanase, Hozumi, Japan

[73] Assignee: Howa Machinery, Ltd., Aichi, Japan

[21] Appl. No.: 93,005

[22] Filed: Sep. 4, 1987

[30] Foreign Application Priority Data

Sep. 9, 1986 [JP] Japan ..... 61-211866

[51] Int. Cl.[4] ..... E01H 1/08

[52] U.S. Cl. ..... 15/340.1; 15/346; 15/347; 15/352; 15/353; 55/432

[58] Field of Search ..... 15/340.1, 347, 352, 15/353, 345, 346; 55/432, 459.1, 459.3

[56] References Cited

U.S. PATENT DOCUMENTS

| | | | |
|---|---|---|---|
| 2,812,217 | 11/1957 | Koch et al. | 55/432 X |
| 3,172,143 | 3/1965 | Yucis et al. | 15/340 |
| 3,512,206 | 5/1970 | Young | 15/340 X |
| 3,545,181 | 12/1970 | Young | 55/432 |
| 4,006,511 | 2/1977 | Larsen | 15/340 X |
| 4,388,091 | 6/1983 | Khosropour | 55/432 X |
| 4,660,248 | 4/1987 | Young | 15/352 X |

*Primary Examiner*—Harvey C. Hornsby
*Assistant Examiner*—Stephen F. Gerrity
*Attorney, Agent, or Firm*—Wenderoth, Lind & Ponack

[57] ABSTRACT

A road-cleaning vehicle has a pneumatic pickup head held against the road surface for collecting rubbish therefrom as a current of air is supplied from a blower. Carrying the collected rubbish, the air flows from the pickup head to a rubbish hopper in which the rubbish is deposited. Rid of the rubbish but still laden with dust particles, the air flows from the rubbish hopper to an air-dust separation chamber having a generally cylindrical shape, in which the dust is centrifugally separated from the carrier air as the latter spirals toward the blower. The air-dust separation chamber has a dust outlet open to an entrance end of a dust collection vessel generally sloping downwardly as it extends away from the air-dust separation chamber and terminating at an exit end open to the rubbish hopper. Hingedly mounted to the exit end of the dust collection vessel is a door which, during the rotation of the blower, is closed against the exit end by virtue of a partial vacuum created in the vessel, until the weight of the separated dust on the door overcomes the suction being exerted thereon. Preferably, the dust particles are sprayed with water before being admitted into the air-dust separation chamber.

7 Claims, 7 Drawing Sheets

AIR-DUST SEPARATION SYSTEM FOR A PNEUMATIC ROAD-CLEANING VEHICLE

BACKGROUND OF THE INVENTION

This invention relates generally to special purpose motor vehicles and has particular pertinence to a vehicle for cleaning the road or street by means of a recirculating airflow while traveling. Still more specifically, the invention deals with improved means on such a road-cleaning vehicle for effecting separation of dust from the recirculating air.

U.S. Pat. No. 3,545,181 represents a typical prior art air-dust separation system for road-cleaning vehicles. This prior art system teaches a centrifugal air-dust separation chamber having a cylindrical shape including an open end directed toward a blower, which produces a powerful airflow by drawing air from the separation chamber. This chamber has an inlet opening which extends parallel to its axis and which is so defined and arranged that the dust-laden air in the rubbish hopper of the vehicle is drawn substantially tangentially into the chamber by virtue of a partial vacuum created therein by the blower. Therefore, as the dustladen air spirals in the chamber and flows toward the blower, the dust particles are centrifugally forced out of a dust outlet of the chamber which is in direct communication with the hopper.

The above-stated conventional air-dust separation system has several drawbacks. One of these arises from the fact that the dust outlet of the air-dust separation chamber is open directly to the rubbish hopper. Since the blower creates a partial vacuum in the air-dust separation chamber, the dust-laden air has been drawn therein not only through the air inlet but also through the dust outlet. Accordingly, the only dust particles actually expelled through the dust outlet are those which have sufficient mass to overcome the force of the undesired inflowing air. The dust particles having a smaller mass that have not been freed from the recirculating air are drawn toward the blower, with some of such particles striking the impeller of the blower. The dust particles striking the blower can, indeed, be likened to the abrasive powder used in shot blasting, so rapid has been the abrasion of the impeller. Furthermore, as the impeller itself centrifugally hurls the dust particles away, the housing of the blower has also been subjected to rapid wear. This problem becomes all the more serious when the vehicle is cleaning sandy or gravelly roads. In the worse case known to the applicant, the useful life of the blower and its housing was only about one month.

Another inconvenience caused by the prior art road-cleaning vehicles of the type under consideration has been the pollution of atmospheric air with the dust discharged therefrom. The usual practice with road-cleaning vehicles is to admit fresh atmospheric air into the pickup head from its front side at a rate depending upon the prevailing kind of rubbish to be collected, with the concurrent partial exhaustion of the recirculating air at a matching rate. For such partial exhaustion of the recirculating air, an exhaust duct is mounted to the blower housing for communication with its interior via a regulator door. The rate of admission of atmospheric air can be controlled by regulating the rate at which the recirculating air is drawn off past the regulator door.

The air pollution problem particularly manifests itself when the rubbish to be collected is predominantly lightweight matter such as dead leaves or waste paper. For efficiently drawing up such lightweight rubbish, the regulator door is fully opened, with the consequent admission of atmospheric air, and exhaustion of the recirculating air, at the maximum rate. Such exhaust air has heretofore contained large amounts of fine dust particles that have not been separated from the recirculating air by the prior art means.

It has been suggested to avoid air pollution to employ a high pressure blower, in addition to that for air recirculation within the vehicle, exclusively for forcing the dust-laden air through a nonwoven fabric filter prior to exhaustion. The provision of such additional filtration means, including, of course, means for reconditioning the filter, is objectionable not only from the standpoint of the added costs for their manufacture and installation but also from that of the inevitable reduction of the hopper capacity.

SUMMARY OF THE INVENTION

The present invention defeats the above-discussed drawbacks and inconveniences of the prior art by making possible the efficacious elimination of dust particles, including much finer ones than those having been heretofore eliminated, which are contained in the air recirculating in a road-cleaning vehicle of the type in question.

In summary, the invention particularly features a dust collection vessel disposed between the air-dust separation chamber and rubbish hopper of a road-cleaning vehicle. The dust collection vessel has a dust inlet in open communication with the separation chamber for receiving therefrom the dust that has been separated from the recirculating air, and a dust outlet open to the rubbish hopper for the discharge of the separated dust. At least the bottom of the dust collection vessel slopes downwardly as it extends from the dust inlet to the dust outlet, so that the dust will travel by gravity through the collection vessel from the inlet to the outlet. The dust outlet of the vessel is openably closed by a hinged door.

During the cleaning operation of the vehicle, with the blower rotating, the door automatically closes the dust outlet of the vessel under suction imparted thereto due to a partial vacuum created in the air-dust separation chamber by the blower, thereby preventing the inflow of the dust-laden air from the rubbish hopper into the collection vessel. When the weight of the collected dust on the door overcomes the suction being imparted thereto, the door will open for instantaneous discharge of the collected dust into the rubbish hopper.

It should be appreciated that, except for the brief periods of dust discharge, the outlet of the dust collection vessel is held closed as long as the blower is rotating. With the dust collection vessel thus discommunicated from the rubbish hopper, the dust particles will be separated from the recirculating airflow in the air-dust separation chamber far more effectively than if the chamber has its dust outlet in open communication with the hopper as in the prior art.

The invention additionally features a filter disposed between the rubbish hopper and the air-dust separation chamber for the removal of relatively coarse solids from the recirculating air, and means disposed downstream of the filter for spraying the dust particles with water prior to their entry into the air-dust separation chamber. So dampened, the dust particles are heavier and, consequently, will be more readily separated from the air by forming a fluid layer on the surface defining the separation chamber. The fluid layer will travel slowly toward the dust outlet of the separation chamber and will serve an additional purpose of protecting its bounding surface from rapid wear.

The above and other features and advantages of this invention and the manner of realizing them will become more apparent, and the invention itself will be best understood, from a study of the following description and appended claims, with reference to the attached drawings showing a preferred embodiment of the invention.

DETAILED DESCRIPTION OF THE PREFERRED EMBODIMENT

Figure 1:
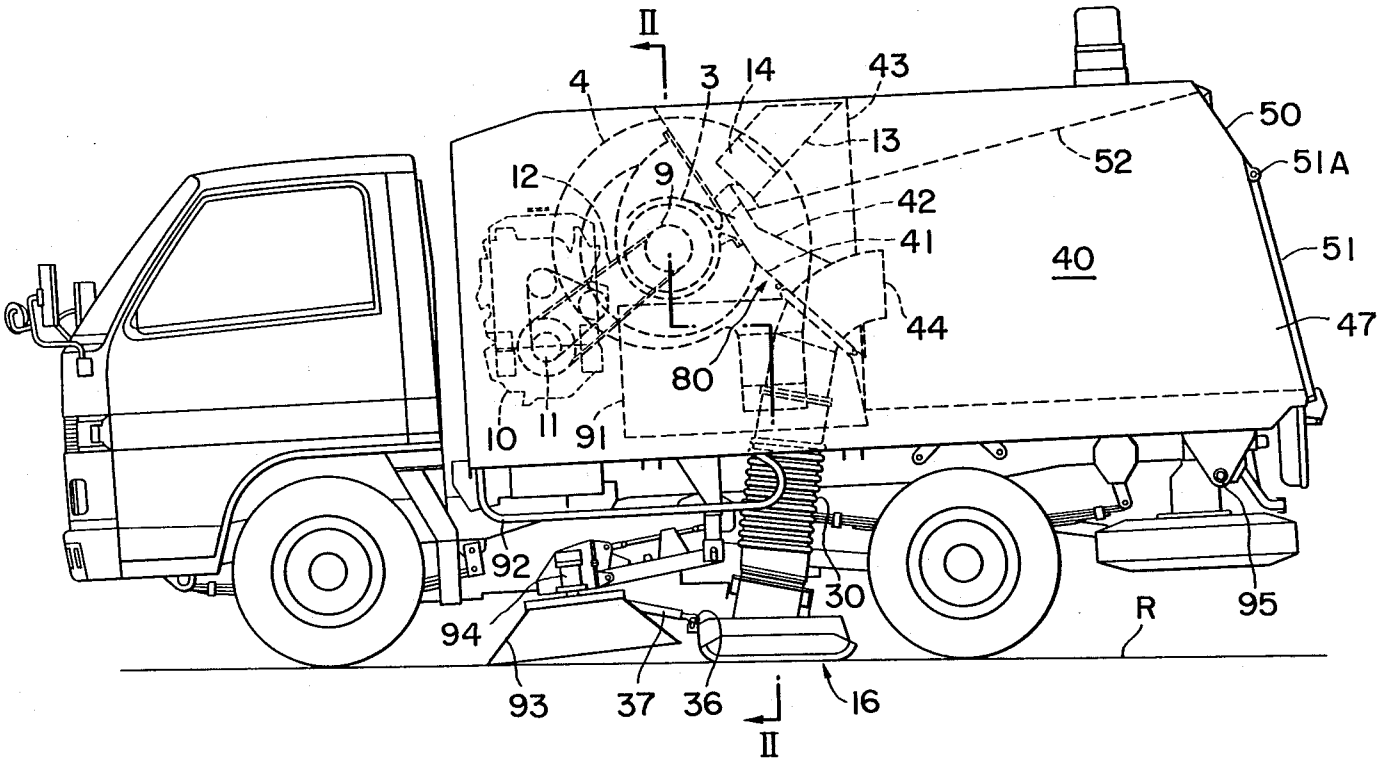
FIG. 1 is a side elevation view of the pneumatic road-cleaning vehicle embodying the principles of the invention.

The illustrated four-wheeled road-cleaning vehicle will first be described with reference to FIGS. 1 and 2. The vehicle has a pair of chassis members 1, FIG. 2, extending longitudinally of the vehicle in a parallel spaced relation to each other. Rigidly mounted on these chassis members 1 are a pair of upstanding support walls 2 supporting a welded-on enclosure 3B having a substantially cylindrical shape or, more exactly, a convolute cross-sectional shape defining a centrifugal air-dust separation chamber 3, as will be subsequently described. The separation chamber enclosure 3B extends transversely of the vehicle and has a closed end, shown directed to the left in FIG. 2, and an open end oriented in the opposite direction.

Welded to the open end of the enclosure 3B, a blower housing 4 accommodates a blower 7 having an impeller 8 mounted fast on a shaft 8A. This impeller shaft 8A is rotatably journaled in a bearing 6 mounted to the end plate 5 of the blower housing 4. As indicated in FIG. 1, a V-belt 12 extends between a driven pulley 9 on the impeller shaft 8A and a drive pulley 11 on the crankshaft of an internal combustion engine 10. Thus, the impeller 8 is engine driven at a high speed. An exhaust duct 13 is mounted to the endplate 5 of the blower housing 4 via a pivotal regulator door 14. Under the control of an operator in the cab of the vehicle, the regulator door 14 is movable between the solid line full-closed position and the phantom line full-open position. The blower housing 4 has its bottom end in constant open communication with an air delivery duct 15, having a bellows-like contractable part 15A, and with a pickup head 16.

Figure 6:
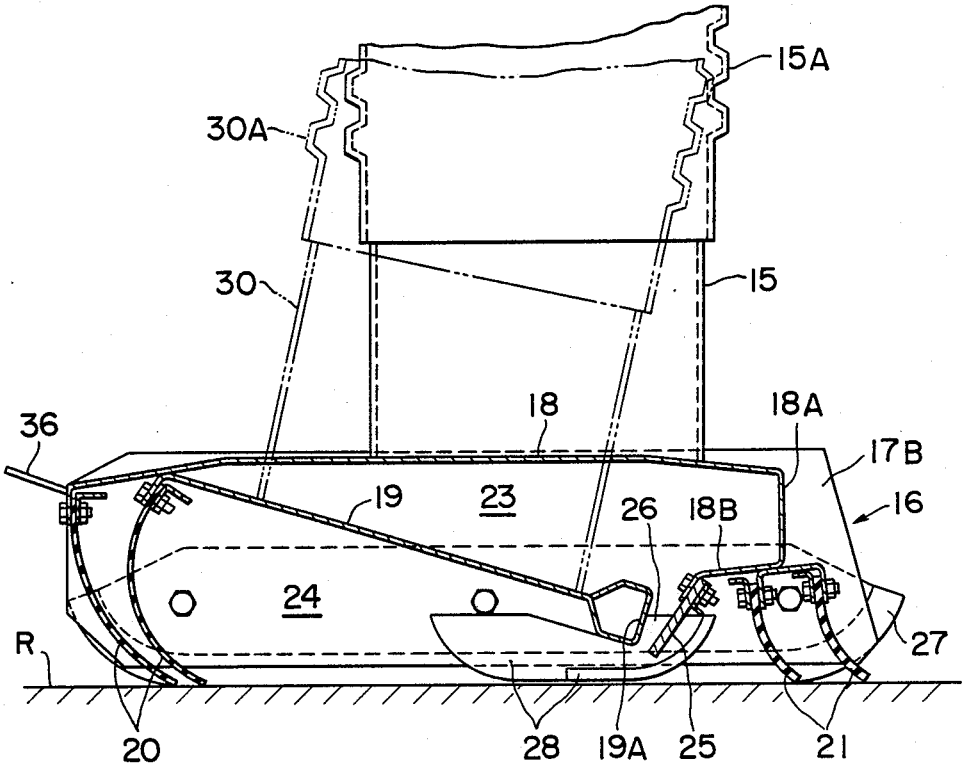
FIG. 6 is an enlarged sectional view taken along line VI—VI in FIG. 2 and showing in particular the pickup head of the vehicle.

As will be seen also from FIG. 6, which shows the pickup head 16 in section as taken along the longitudinal median plane of the vehicle, the pickup head comprises a pair of side walls 17A and 17B, a top wall 18 having its rear end portion shaped as a recumbent U and including a rear wall 18A and a bottom flange 18B, and a slanting partition 19 dividing the interior of the head into an upper compartment 23 and a lower compartment 24. All these walls and the partition can comprise sheet metal and may be welded to one another. The noted delivery duct 15 is joined to the right hand end, as seen in FIG. 2, of the pickup head 16 so as to be in constant communication with its upper compartment 23. A suction duct 30, having a bellows-like contractable part 30A, is joined to the left hand end of the pickup head 16 and is in constant communication with lower compartment 24.

Additional components of the pickup head 16 are two sheet-rubber front flaps 20 depending from the front ends of the top wall 18 and partition 19, and two parallel sheet-rubber rear flaps 21 depending from the rear wall 18A, each of which are in sliding engagement with the road surface R. These flaps 20 and 21 prevent leakage of the pressurized air from the front and rear ends of the pickup head 16.

FIG. 6 also reveals a venturi orifice 26 formed between the compartments 23 and 24 of the pickup head 16 and directed toward the road surface R. The venturi orifice 26 is defined by a rear end enlargement 19A of the partition 19 and a welded-on extension 25 of the bottom flange 18B of the rear wall 18A. The pickup head 16 is further provided with a pair of dirt shoes 27, FIG. 2, bolted or otherwise mounted to the outer surfaces of the side walls 17A and 17B for sliding along the road surface R, and with air deflector means 28 for preventing lateral and rearward leakage of the airflow that is directed by the venturi orifice 26 against the road surface.

Figure 2:
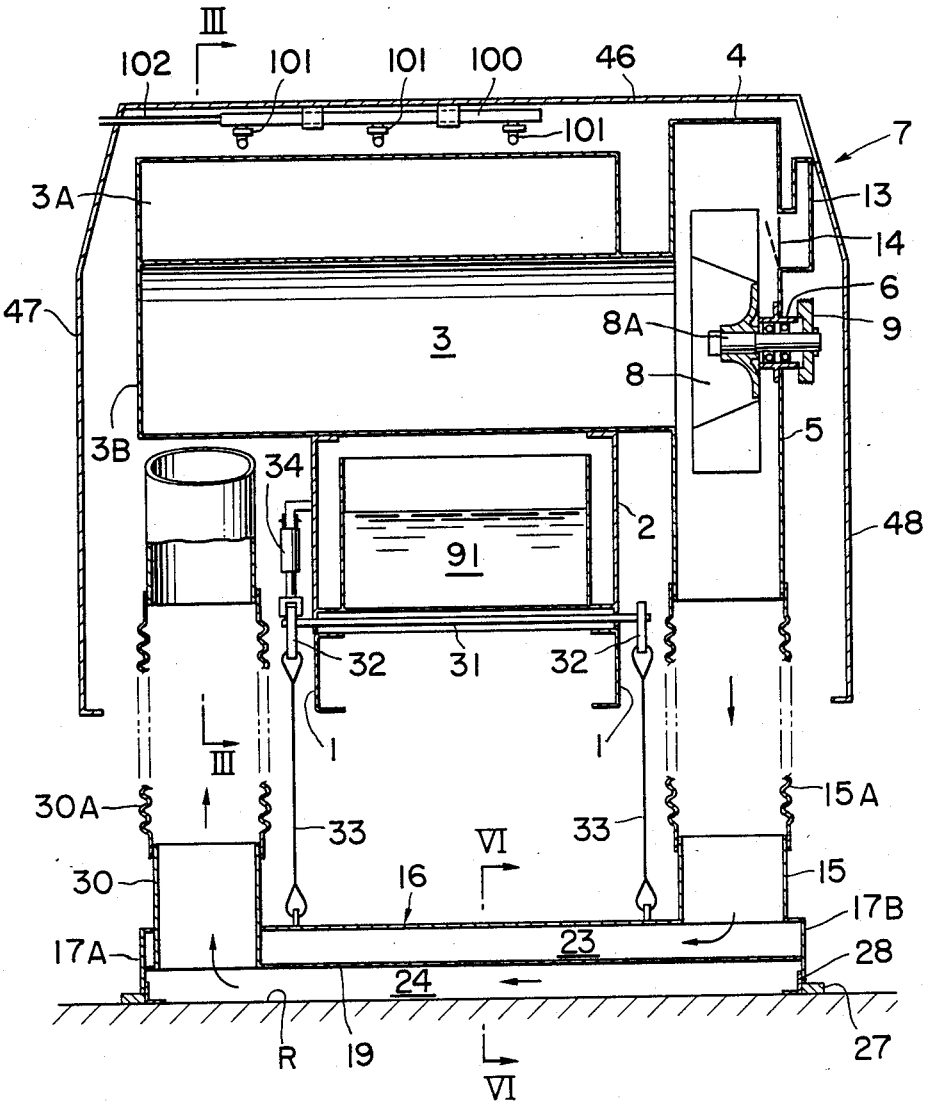
FIG. 2 is an enlarged cross-section view of the vehicle, taken along line II—II in FIG. 1 and showing the various road-cleaning and dust-separating means of the vehicle.

Such being the construction of the pickup head 16, the airflow that has been introduced into the pickup head 16 from the delivery duct 15 will flow from right to left, as seen in FIG. 2, through the upper pickup head compartment 23. After filling the upper pickup head compartment 23, the air will be directed by the venturi orifice 26 against the road surface R as a powerful stream. The airstream issuing from the venturi orifice 26 will then flow from the lower pickup head compartment 24 up into the suction duct 30, carrying away the dust, rubbish and any other loose matter from the road surface R.

As will be noted from FIG. 2, the pickup head 16 is suspended from a pair of lift arms 32 via wire ropes 33. The lift arms 32 are rigidly mounted on the opposite ends of a shaft 31 which in turn is rotatably mounted on the vehicle chassis members 1 and which extends transversely of the vehicle. A fluid actuated cylinder 34, preferably hydraulic, acts between one of the support walls 2 and one of the lift arms 32 for reciprocably swinging both arms and to move the pickup head 16 up and down. The cylinder 34 is extended during the cleaning operation of the vehicle, with the pickup head 16 in the illustrated working position sliding contact with the road surface R. When the cylinder 34 is retracted the pickup head 16 will retract out of contact with the road surface, the bellows-like parts 15A and 30A of the ducts 15 and 30 being contractable to permit such retraction of the pickup head.

At 36 in FIG. 6 is shown a tongue extending forwardly of the vehicle from the top wall 18 of the pickup head 16. This tongue is coupled to a pivotal link 37, FIG. 1, on the vehicle chassis for maintaining the pickup head 16 in a required position in the longitudinal direction of the vehicle.

Figure 3:
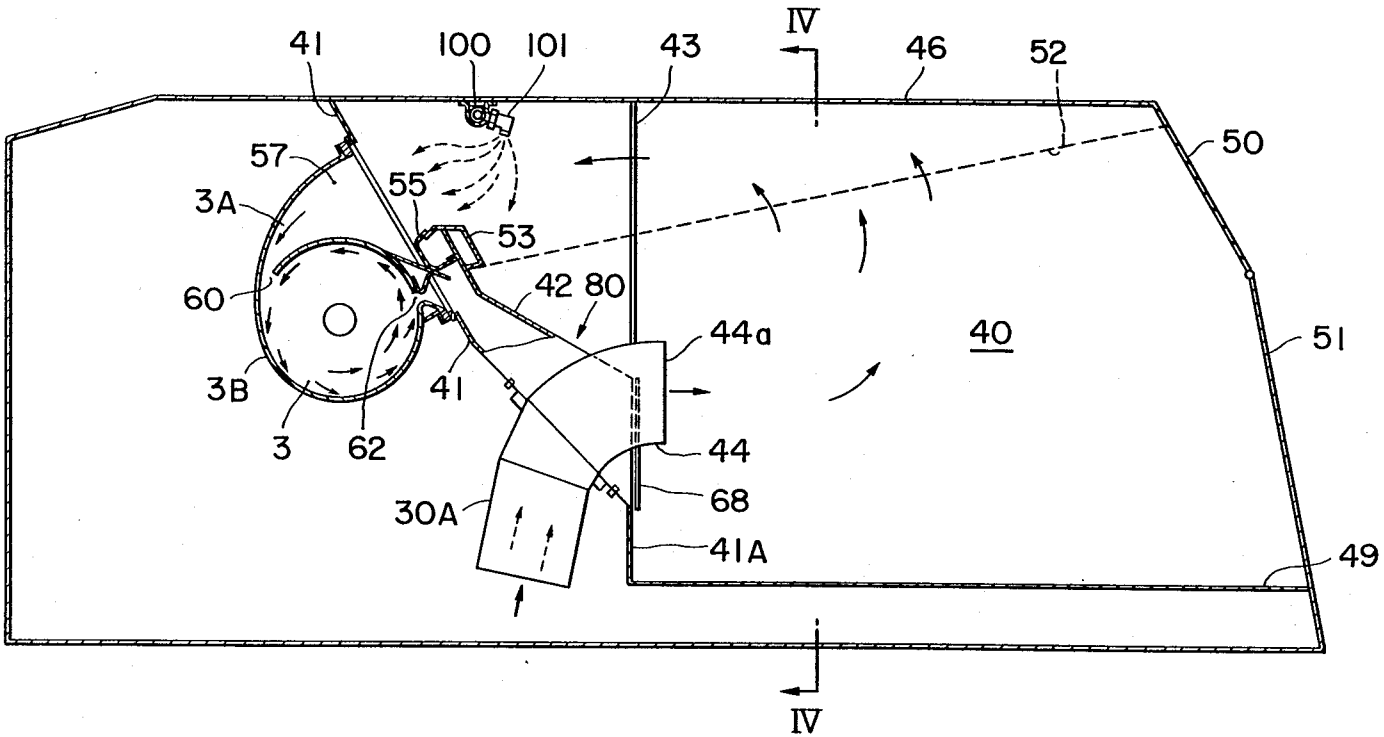
FIG. 3 is a sectional view taken along line III—III in FIG. 2.

Extending upwardly from the pickup head 16, the suction duct 30 has its top end coupled to an elbow 44, as shown in FIG. 1 and in more detail in FIG. 3. The elbow 44 is mounted to, and extends through, a slanting front wall part 41 of a rubbish hopper 40. The open end 44*a* of the elbow 44 provides a rubbish outlet of the suction duct 30 from which the rubbish-laden air is introduced into the hopper 40, with the consequent deposition of the collected rubbish therein.

With reference to FIGS. 1–4 the rubbish hopper 40 comprises, in addition to the slanting front wall part 41, another slanting front wall part 42, an upstanding front wall part 43, a top wall 46, a pair of side walls 47 and 48, an inside wall or partition 54, a bottom 49, a rear wall 50, and a tail door 51, all defining in combination a relatively large rubbish chamber for accommodating the rubbish from the rubbish outlet 44*a* of the suction duct 30. The top wall 46 and side walls 47 and 48 extend forwardly beyond the front extremities of the hopper 40 to provide a covering for the engine 10, blower 8, separation chamber enclosure 3B and other parts which will be described below. The tail door 51 has its top edge hinged at 51A, as seen in FIG. 1, to the bottom edge of the rear wall 50. When the rubbish hopper is tilted about a horizontal axis indicated at 95 in FIG. 1, the tail door will open for dumping the collected rubbish.

Mounted within the rubbish hopper 40 and adjacent its top wall 46 is a filter screen 52 serving as an air outlet in communication with the air-dust separation chamber 3. The filter screen 52 may comprise wire mesh or expanded metal, the size of the mesh being such that air carrying only relatively fine dust particles is admitted there-through.

Figure 4:
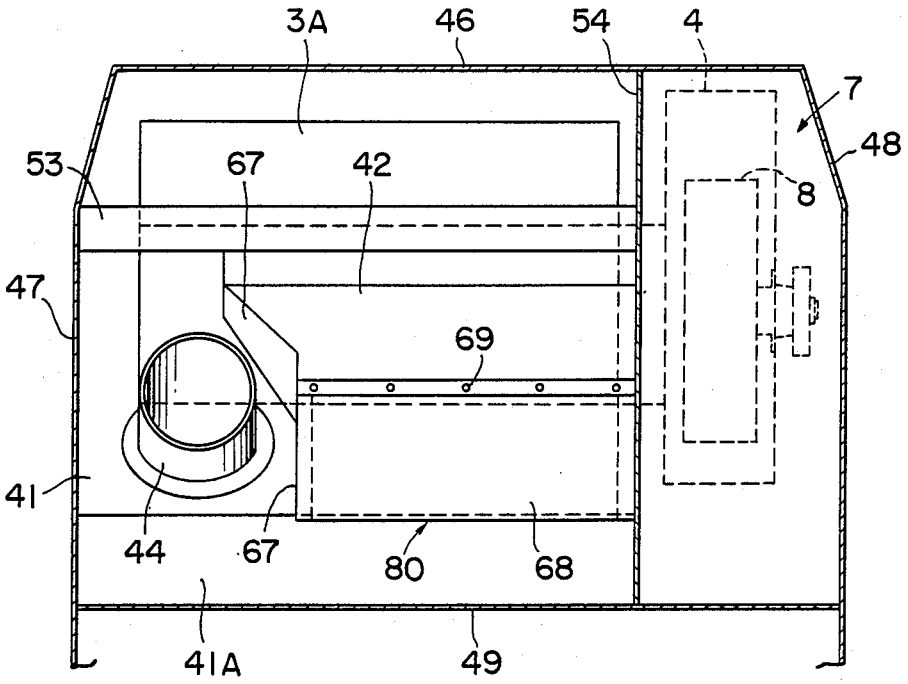
FIG. 4 is a sectional view taken along line IV—IV in FIG. 3.
Figure 5:
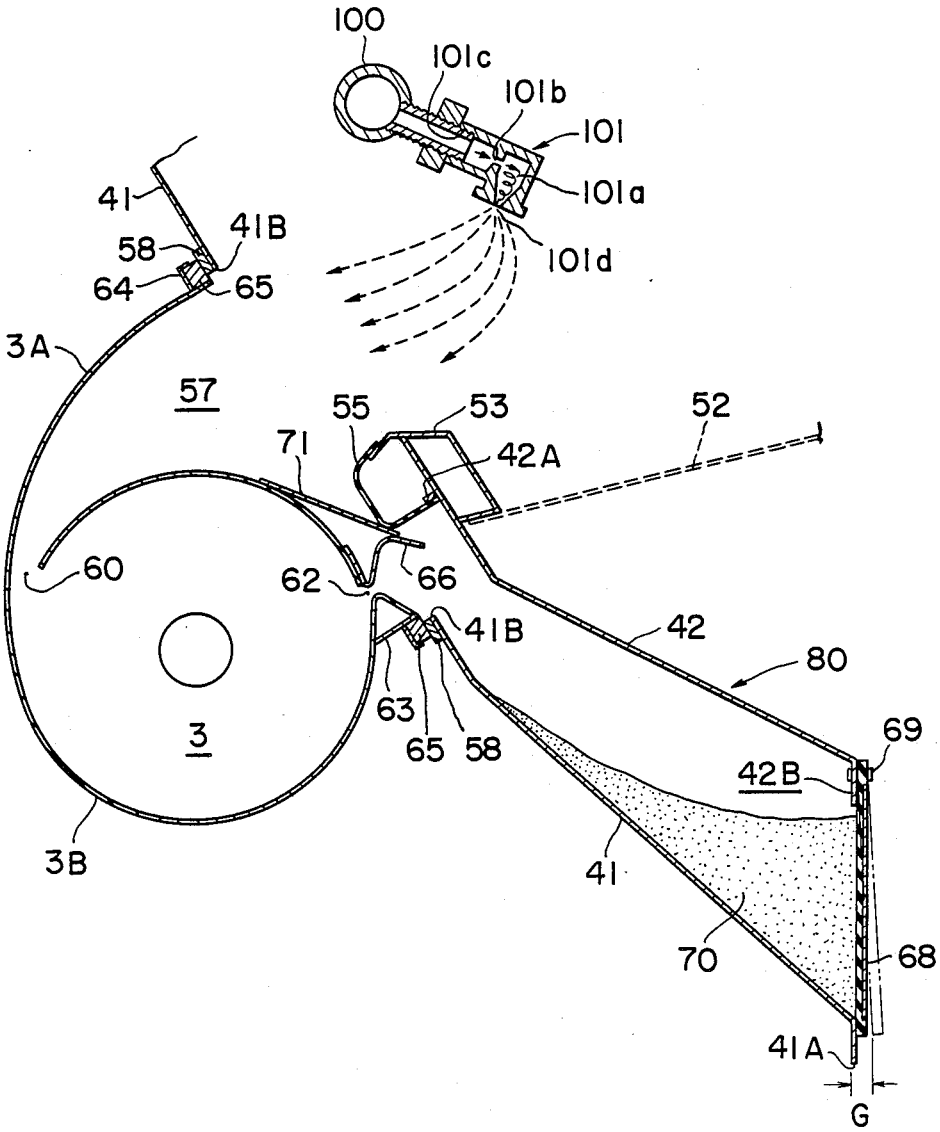
FIG. 5 is an enlarged sectional view, taken longitudinally of the vehicle, showing in particular the air-dust separation means, dust collection means, and watering means of the vehicle.

As will be noted from both FIGS. 4 and 5, a channel-shaped beam or stay 53 extends transversely of the vehicle and has it opposite ends welded to the hopper walls 47 and 54. The slanting front wall part 42 of the hopper 40 has its top edges welded to the stay 53. The other slanting front wall part 41 has its side edges welded to the hopper walls 47 and 54. A strip 55 of rubber or similar material, longitudinally bent into the shape of a recumbent U, has its opposite longitudinal edges attached to the stay 53 and to a flange 42A that is unitary with the slanting front wall part 42.

FIG. 5 further indicates that the slanting front wall part 41 of the hopper 40 has defined therein an opening 41B that is generally rectangular for allowing the passage of the dust-laden air from the filter screen 52 into the air-dust separation chamber 3. The edges of the wall part 41 bounding the opening 41B have rectangularly arranged rim members 58 welded thereto.

The road-cleaning vehicle in accordance with the invention is further provided with means for watering the airborne dust particles flowing from hopper 40 toward air-dust separation chamber 3 thereby expediting the separation of the dust from its carrying air. Reference is directed to FIGS. 2, 3, 5 and 7 for the following detailed discussion of the watering means.

Included in the watering means is a water pipe or conduit 100 clamped to the inside surface of the top wall 46 so as to extend transversely of the vehicle and disposed intermediate the hopper 40 and the air-dust separation chamber 3. The water conduit 100 is provided with a plurality of, three in this embodiment, spray nozzles 101 spaced longitudinally at constant intervals. The spray nozzles 101 are oriented somewhat toward the entranceway 57 of the air-dust separation chamber 3. As illustrated in the axial section view of FIG. 5, each spray nozzle 101 has a cone-shaped nozzle chamber 101*a* with an inlet port 101*b* for admitting a pressurized stream of water approximately in the tangential direction of the nozzle chamber. The inlet port 101*b* communicates with the conduit 100 via a cylindrical passageway 101*c*.

Figure 7:
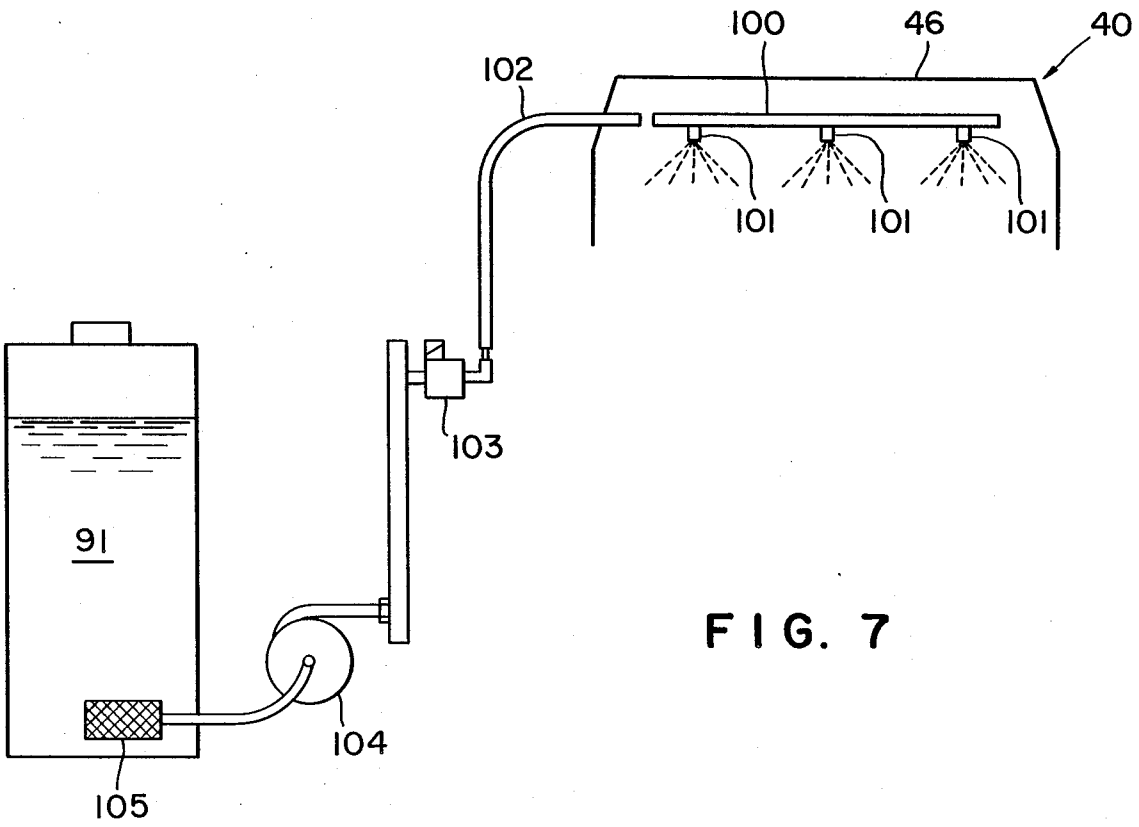
FIG. 7 is a diagrammatic illustration of the conduit system for the delivery of pressurized water to the watering means shown in FIG. 5.

FIG. 7 shows that the conduit 100 communicates with a water vessel 91 via a flexible conduit 102, on-off valve 103, pump 104 and strainer 105. The water vessel 91 may be mounted in any convenient location on the vehicle chassis, such as under the air-dust separation chamber 3 as illustrated in FIGS. 1 and 2. Preferably, the on-off valve 103 is solenoid operated, with the solenoid connected in a circuit with the blower 7 so that the valve may be automatically opened when the operation of the blower is initialed.

Thus, when the valve 103 is opened, water will be pumped from the vessel 91 into the conduit 100, forced into the chamber 101*a* of each spray nozzle 101, will form a spiraling stream therein and will be ejected from outlet port 101*d* in the form of a fine spray having a generally conical shape thereby moistening the dust particles carried by the air stream from hopper 40 to air-dust separation chamber 3.

Typically, the flow rate of the dust-laden air that has passed the filter screen 52 is 250 cubic meters per minute. Water may be sprayed at a rate of 2.4 liters per minute to sufficiently moisten the dust particles that are carried by that air stream.

As best seen in FIG. 5, the convolute enclosure 3B of the centrifugal air-dust separation chamber 3 may be described as having a cross-section shape of the numeral 6. Thus the enclosure 3B includes a baffle portion 3A having an arcuate cross section such that the dust-laden air from the hopper 40 will flow substantially in a tangential direction of the cylindrical separation chamber 3 as such air enters the intake opening 60 extending longitudinally of the enclosure 3B. A dust discharge opening 62 is also defined in the enclosure 3B in an approximately diametrically opposed relation to the intake opening 60. Extending substantially the full length of the enclosure 3B, the discharge opening 62 places the air-dust separation chamber 3 in communication with a dust collection vessel 80 in which the dust collects when separated from its carrier air in the chamber 3.

A pair of sealing strips 65 of rubber or similar material are engaged in grooves formed by welding L-shaped flanges 63 and 64 to the enclosure 3B, in a position just under the discharge opening 62, and to the edge of the baffle portion 3A of the enclosure 3B. The sealing strips 65 are hermetically held against the rims 58 on the slanting wall part 41 thereby preventing the intrusion of atmospheric air into the rubbish hopper 40, dust collection vessel 80, etc. A dust guide 66 having a V-shaped cross section is welded to the outer surface of the separation chamber enclosure 3B in a position just above the discharge opening 62 in order to guide the discharged dust into the collection vessel 80. A sealing plate 71 has it opposite longitudinal edges welded to the separation chamber enclosure 3B and to the dust guide 66, and the noted elastic sealing strip 55 is held against the sealing plate 67 for hermetically closing the top of the dust collection vessel 80.

The top and bottom of the dust collection vessel 80 are formed respectively by the slanting front wall part 42 of the hopper 40 and by part of the other slanting front wall part 41 of the hopper. The opposite sides of the vessel 80 are formed by part of the partition 54 and by a side wall 67. The vessel 80 is inclined downwardly as it extends rearwardly from the air-dust separation chamber 3, and terminates at a dust outlet which is closed by a hinged door 68 and which, when the door is opened, is in direct communication with the hopper 40.

As will be seen from both FIGS. 4 and 5, the door 68 typically takes the form of a rectangular piece of iron sheet metal complete with a rubber lining which has a marginal edge portion protruding beyond the upper edge of the sheet metal. This marginal edge portion of the rubber lining is bolted at 69 to a flange 42B depending from the lower or rear edge of the slanting wall part 42. Essentially, therefore, the door 68 has its upper edge hinged to the flange 42B and depends therefrom under its own weight. The lower edge of the door 68 is held opposite an approximately vertical front wall part 41A of the hopper 40 which is integral with the slanting front wall part 41 and which is welded to the bottom 49 of the hopper, as will be understood from FIGS. 3 and 4.

Normally, or when the blower 7 is not rotating, the door 68 will be in the position indicated by the phantom outline in FIG. 5. A gap G will then exist between the lower edge of the door 68 and the wall part 41A, resulting in the open communication of the dust collection vessel 80 and the hopper 40. When the blower 7 is rotated, a partial vacuum created in the air-dust separation chamber 3 will draw the door 68 to the solid line position of FIG. 5, in which the door closes the dust outlet of the vessel 80.

With reference back to FIG. 1 the illustrated road-cleaning vehicle is further conventionally furnished with a side guard 92 and a rotary gutter broom 93 disposed forwardly of the pickup head 16. The gutter broom 93 is driven by an overlying hydraulic motor 94.

OPERATION

When the blower 7 is rotated by the internal combustion engine 10, the resulting current of pressurized air will travel through the delivery duct 15 into the pickup head 16. After filling the upper compartment 23 of the pickup head 16, the air under pressure will flow through the venturi orifice 26 thereby forming a powerful jet directed against the road surface R. Then, after filling the lower compartment 24, the pressurized air will stream into the suction duct 30, carrying the rubbish and dust away from the road surface and into the rubbish hopper 4. Stones, pebbles, empty beverage cans and similar relatively heavy pieces of rubbish will be deposited under their own weight in the rubbish hopper 40. Then the pressurized air will pass through the filter screen 52 thereby being rid of relatively lightweight, coarse rubbish.

After emerging from the hopper 40, the dust-laden air will stream forwardly of the vehicle toward the air-dust separation chamber 3. Just before, or upon, reaching the entranceway 57 of the air-dust separation chamber 3, the dust-laden air will be subjected to water sprayed from the overhead spray nozzle 101. The dust particles when thus moistened will readily stick to one another to form particles having a greater mass. Such moist, cohering dust particles will flow tangentially into the cylindrical air-dust separation chamber 3 and, while circulating therein as indicated by the arrows in FIG. 3, will be deposited on the inside surface of the enclosure 3B in the form of a fluid layer.

Referring back to FIG. 2, the air-dust separation chamber 3 is open at an end thereof to the blower 7, which is now rotating. The dust-laden air that has been introduced into the chamber 3 will be drawn in a spiral stream toward the revolving impeller 8. As the air thus spirals toward the blower 7, the moist dust particles will be centrifugally flung outwardly far more easily than if they were not moistened, and will settle on the existing fluid layer of dust on the inside surface of the enclosure 3B.

The spiraling airstream also facilitates a gradual forcing of the fluid dust layer toward the discharge opening 62 of the air-dust separation chamber 3. The watered dust particles will travel over the inside surface of the enclosure 3 appreciably more slowly than if they were dry, thereby protecting the enclosure from rapid abrasion.

While issuing from the chamber 3 through discharge opening 62, the dust particles will hit the dust guide 66 and then fall into the collection vessel 80. The hinged door 68 of this vessel 80 is now pneumatically held closed as discussed above because of the rotation of the blower 7. The dust that has been separated from the carrier air will therefore collect in the vessel 8, as indicated at 70 in FIG. 5. It should be appreciated that as long as the door 68 remains closed as indicated by the solid lines in FIG. 5, approximately the same degree of vacuum prevails within the vessel 80 as in the air-dust separation chamber 3, expediting the transfer of the dust from the former to the latter.

With an increase in the amount of the collected dust in the vessel 8, a decreasing surface area of the door 68 will be subjected to the suction due to the blower 7. Finally, when the weight of the collected dust 70 overcomes the suction being exerted on the door 68, the door will open to permit the collected dust to fall into the rubbish hopper 40 almost in an instant. Then the door 68 will be reclosed to suction. It is thus seen that the door 68 automatically opens when a predetermined amount of dust collects in the vessel 80, and automatically closes when the predetermined amount of dust has been discharged. Furthermore, when the rotation of blower 7 ceases, the door 68 will become free from suction and thus hang from the flange 42B under its own weight, providing the gap G between its lower edge and the opposed wall part 41B of the hopper 40. Any dust that has accumulated in the vessel 80 will then fall through the gap G into the hopper 40.

Separated from the dust particles in the chamber 3, the clean air will be drawn into the blower 7 to be forced out into the delivery duct 15. Part of the recirculating air may be exhausted through the exhaust duct 13 on the blower housing 4. The exhaust air will be so clean, so free from the finest dust particles, that no pollution problem will occur.

Despite the foregoing detailed disclosure, the invention is not limited to the exact details of such disclosure. For example, in the illustrated embodiment, the hopper 40 is provided with the slanting front wall parts 41 and 42 which also serve as the top and bottom walls of the dust collection vessel 80. Although this construction is recommended from the standpoints of providing greater hopper capacity and facilitating the ease of manufacture and low cost of the vessel 80, it is of course possible to form the hopper and the vessel as separate units. As another possible modification of the vessel 80, the vessel may be divided into two constituent sections held endwise against each other, with one of the vessel sections mounted to the air-dust separation chamber enclosure and the other to the hopper. The two vessel sections will separate when the hopper 40 is tilted to the dumping position and will rejoin when the hopper is brought down to the illustrated normal position.

It should also be understood that the dust watering system comprising the spray nozzles 101 is a preferred, but not an essential, feature of the invention. Dust will be separated to a satisfactory degree from the recirculating air stream by the separation means of the invention even if the dust particles are not moistened before entering the air-dust separation chamber.

Additional modifications and alterations of the illustrated embodiment may be resorted to without departing from the scope of the invention.

What is claimed is:

1. A pneumatic road-cleaning vehicle comprising:

(a) vehicular chassis means;

(b) means on the chassis means defining an air-dust separation chamber having a substantially cylindrical shape, the air-dust separation chamber having an intake opening and a discharge opening, both extending longitudinally thereof, a closed end and an open end;

(c) blower means disposed opposite the open end of the air-dust separation chamber for producing a current of air under pressure by drawing air from the air-dust separation chamber and for creating a partial vacuum in the air-dust separation chamber;

(d) a pickup head communicating with the blower means for directing the current air against a road surface to be cleaned to collect rubbish therefrom;

(e) a rubbish hopper communicating with the pick-up head for accommodating the collected rubbish carried therefrom by the current of air;

(f) the air-dust separation chamber communicating via the intake opening thereof with the rubbish hopper for receiving the current of air laden with at least any dust included in the collected rubbish;

(g) baffle means communicating with the rubbish hopper and the air-dust separation chamber for regulating the flow of the air from the rubbish hopper into the air-dust separation chamber to cause the air within the chamber to spiral so as to effect centrifugal separation of any dust from the air;

(h) a dust collection vessel having an open first end in communication with the discharge opening of the air-dust separation chamber and subject to the partial vacuum created in the air-dust separation chamber by said blower means for receiving the separated dust therefrom, and a second end open to the rubbish hopper, the dust collection vessel generally sloping downwardly as it extends from the first to the second end thereof for causing any dust received in the vessel to travel under gravity from the first to the second end thereof; and (i) a door hingedly attached to the dust collection vessel for openably closing the second end thereof, the second end of the dust collection vessel being closed by the door during the operation of the blower means due to the exertion of the partial vacuum created in the air-dust separation chamber by the blower means on the door until the weight of the dust received in the dust collection vessel is sufficient to overcome the suction exerted on the door.

2. The road-cleaning vehicle as recited in claim 1, wherein a gap exists between the second end of the dust collection vessel and the door when the blower means is not operating, the door automatically closing the second end of the vessel thereby eliminating the gap due to the suction created by the blower means when operating.

3. The road-cleaning vehicle as recited in claim 1, wherein the door comprises:

(a) a piece of sheet metal;

(b) a lining of elastic material attached to the piece of sheet metal and having an upper edge portion extending beyond the piece of sheet metal; and (c) fastener means fastening the upper edge portion of the lining to the dust collection vessel, said fastener means hingedly supporting the door on the dust collection vessel.

4. The road-cleaning vehicle as recited in claim 1, and further comprising:

(a) a filter disposed between the hopper and the air-dust separation chamber for filtering particles larger than the dust particles from the current of air to be received in the air-dust separation chamber; and (b) watering means disposed intermediate the filter and the air-dust separation chamber for directing water toward the intake opening of the air-dust separation chamber to moisten the dust particles in the current of air to be received in the air-dust separation chamber.

5. The road-cleaning vehicle as recited in claim 4, wherein the watering means comprises:

(a) a source of water under pressure; and (b) at least one spray nozzle operatively connected to the pressurized water source and directed toward the intake opening of the air-dust separation chamber for spraying the dust particles with water.

6. The road-cleaning vehicle as recited in claim 1, wherein the rubbish hopper has inclined front wall parts defining said dust collection vessel.

7. The road-cleaning vehicle as recited in claim 1, wherein the rubbish hopper is tiltable for allowing rubbish accumulated therein to be dumped when the rubbish hopper is tilted.

* * * * *